US007772470B1

(12) United States Patent
Olsen

(10) Patent No.: US 7,772,470 B1
(45) Date of Patent: Aug. 10, 2010

(54) GUITAR TREMOLO

(76) Inventor: Raymond Thomas Olsen, 123 Steele Ln., Eureka, CA (US) 95503

( * ) Notice: Subject to any disclaimer, the term of this patent is extended or adjusted under 35 U.S.C. 154(b) by 99 days.

(21) Appl. No.: 12/290,913

(22) Filed: Nov. 5, 2008

Related U.S. Application Data

(60) Provisional application No. 61/019,397, filed on Jan. 7, 2008.

(51) Int. Cl.
*G10D 3/00* (2006.01)

(52) U.S. Cl. ..... 84/313

(58) Field of Classification Search ..... 84/312 R, 84/313, 290, 298
See application file for complete search history.

(56) References Cited

U.S. PATENT DOCUMENTS 4,608,906 A 9/1986 Takabayashi
4,632,005 A 12/1986 Steinberger
4,656,915 A 4/1987 Osuga
4,686,883 A * 8/1987 Piche et al. ..... 84/313
4,742,750 A 5/1988 Storey
4,763,555 A 8/1988 Minakuchi
4,768,415 A 9/1988 Gressett, Jr. et al.

* cited by examiner

*Primary Examiner*—Kimberly R Lockett
(74) *Attorney, Agent, or Firm*—Jim H. Salter

(57) ABSTRACT

A self-contained, surface-mount guitar tremolo is disclosed. A particular embodiment includes a surface-mount base plate; a plurality of individually adjustable string fingers attached to the base plate; side plates attached to the base plate; a first pivot roller attached to the side plates; a second pivot roller attached to the side plates; a rocker attached to the second pivot roller; and a spring preload adjuster attached to the rocker, the spring preload adjuster including a plurality of springs attached at one end to the base plate and attached at a second end to the spring preload adjuster.

10 Claims, 15 Drawing Sheets

3mm x .5mm set screws top and bottom compress aluminum sleave to achieve tight interference fit for activation arm. Facilitates quick attach/detach of rocker actuation arm.

GUITAR TREMOLO

PRIORITY APPLICATION

This is a non-provisional patent application that claims priority to a provisional patent application Ser. No. 61/019,397; filed on Jan. 7, 2008; by the same inventor.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever. The following notice applies to the software and data as described below and in the drawings that form a part of this document: Copyright 2007-2008, Raymond Thomas Olsen, All Rights Reserved.

BACKGROUND

1. Technical Field

This disclosure relates to musical instruments. More particularly, the present disclosure relates to a tremolo for guitars.

2. Related Art

U.S. Pat. No. 4,608,906 discloses a tremolo unit mechanism for electric guitar comprising bridge bodies respectively provided on a bridge base which correspond to respective strings, each of the bridge bodies having a slanted top surface and a string inserting hole. A rocker arm is mounted on the bridge body which pivotally moves in a vertical direction to firmly press the string with the front end portion of the slanted top surface of the bridge body when a locking screw is screwed into the rear end of the rocker arm and press the rear end of the bridge body. An octave tuning screw is connected to the bridge body, which moves the bridge body in the length-wise direction of the string to effect harmonic tuning of the string.

U.S. Pat. No. 4,632,005 discloses a tremolo mechanism for adjusting the spring tension of a stringed musical instrument, the instrument including a body, a neck portion, a plurality of strings each anchored at one end to the neck portion and extending over at least a portion of the neck portion and the body, the mechanism comprising a base for attachment to the body; a pivot plate mounted on the base for detuning the strings substantially evenly and for maintaining the strings in substantially the same pitch relative to each other when the pivot plate is pivoted with respect to the base, including a plurality of sliders for anchoring the other end of each of the strings; and a bridge positioned between the pivot plate and the neck. A method for rapid tuning of a stringed musical instrument, a string for a stringed musical instrument, and an improved stringed instrument are also disclosed.

U.S. Pat. No. 4,763,555 discloses a tremolo unit mechanism for an electric guitar including a bridge base vertically disposed to be pivotal about a support point on a body, balancing springs for causing a balance moment along a direction opposite to that of a moment due to a tension of strings to act on the bridge base, bridge main bodies, disposed on the bridge base, for holding one end of each of the strings, octave adjusting screws, threadably engaged with the bridge base, for moving the bridge base along a front-to-rear direction, a tremolo arm, mounted in the bridge base, for moving the bridge base vertically, and a control mechanism for controlling pivotal movement of the bridge base. The control mechanism includes an engaging member for engaging with the bridge base and a screw member for controlling pivotal movement/displacement of the engaging member.

A self-contained, surface-mount guitar tremolo is needed.

BRIEF DESCRIPTION OF THE DRAWINGS

Embodiments illustrated by way of example and not limitation in the figures of the accompanying drawings, in which.

DETAILED DESCRIPTION

A self-contained, surface-mount guitar tremolo is disclosed. In the following description, numerous specific details are set forth. However, it is understood that embodiments may be practiced without these specific details. In other instances, well-known processes, structures and techniques have not been shown in detail in order not to obscure the clarity of this description. Various embodiments are described below in connection with the figures provided herein.

Description of Various Example Embodiments

The various embodiments described herein relate to a self-contained, surface-mount guitar tremolo system.

Figure 1:
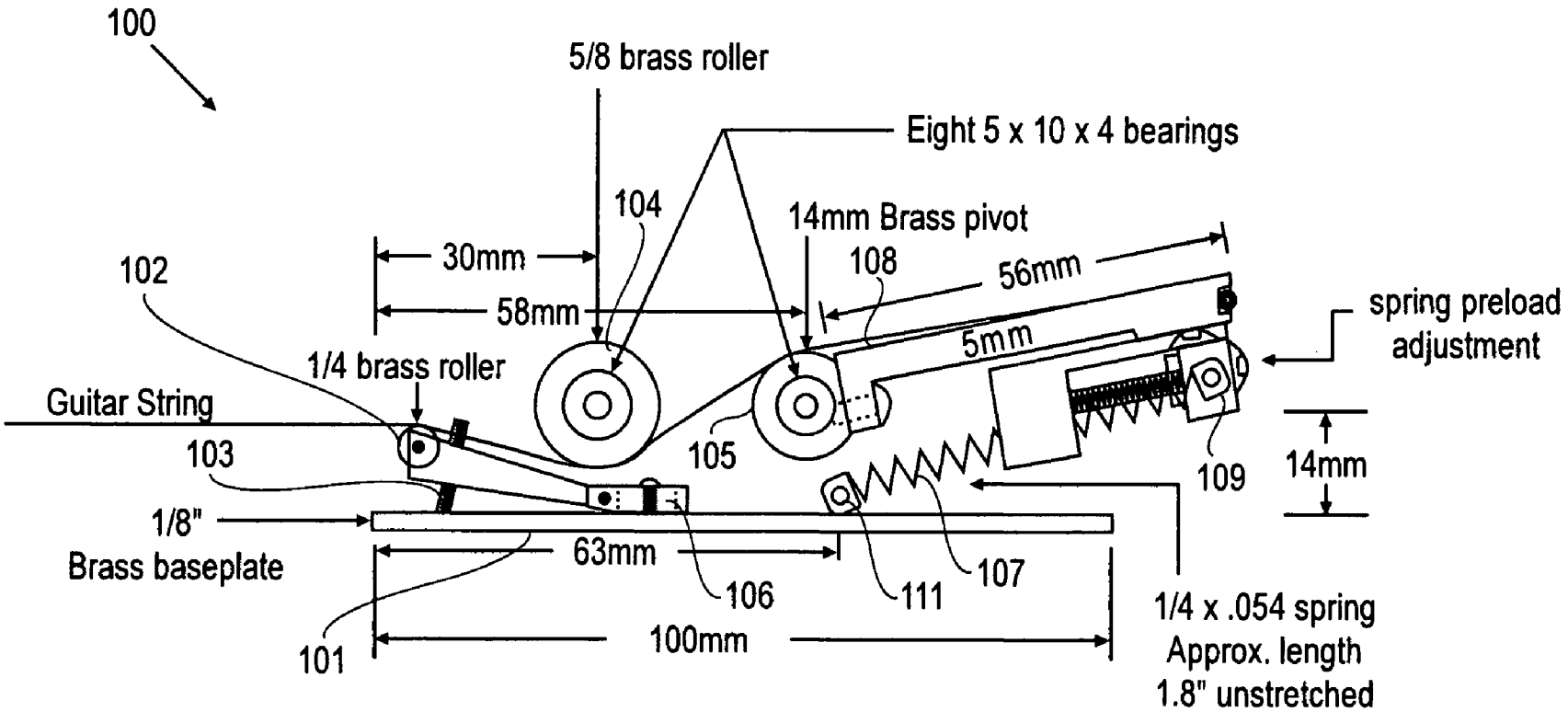
FIG. 1 illustrates a side view of an example embodiment of the guitar tremolo system.
Figure 8:
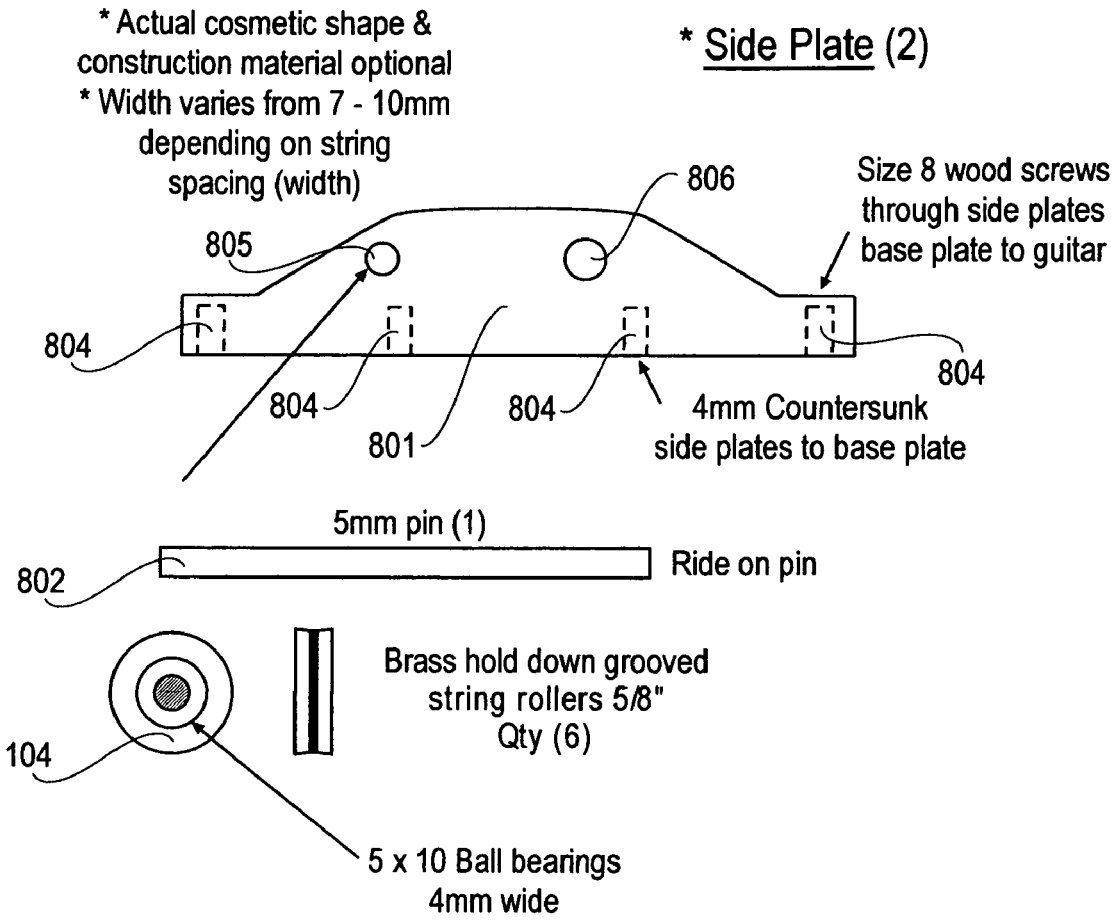
FIG. 8 illustrates a side view of an example embodiment of the side plate of the guitar tremolo system.

Referring to FIG. 1, a particular embodiment of the guitar tremolo system 100 starts with a brass base plate 101 approximately ⅛ inch thick. Six roller tipped string controllers 103 constructed of brass, mount to the base plate at attachment points 106. String controllers 103 are individually adjustable for string height and intonation. Attached to the sides of the base plate 101 are two side plates 801 (shown in FIG. 8) of aluminum that support three pivot points and incorporate four attachment points 804 to facilitate mounting to the guitar. Referring to FIG. 8, a hold-down pin 802 is mounted at the first pivot 805. The hold-down pin 802 maintains pressure on string controllers 103 (shown in FIG. 1). When assembled, the first pivot 805 consists of the hold-down pin 802 on which six grooved brass guide rollers 104 with ball bearing supports are mounted. The guide rollers 104 apply pressure to each of the six guitar strings of a 6-string guitar that run through the groove in the center of the guide rollers 104 as shown in FIG. 8.

Figure 2:
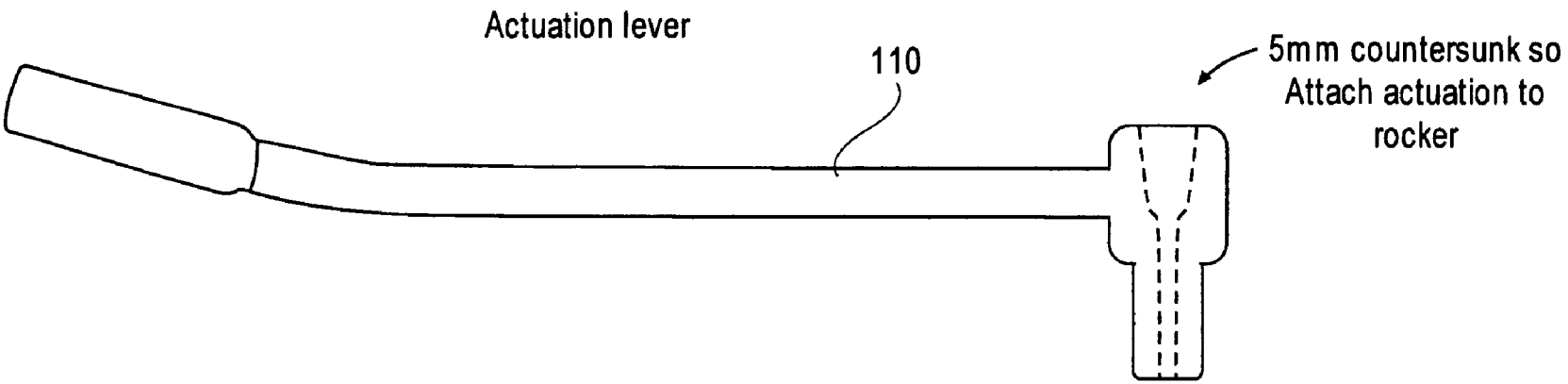
FIG. 2 illustrates a view of an example embodiment of the rocker actuation lever.
Figure 3:
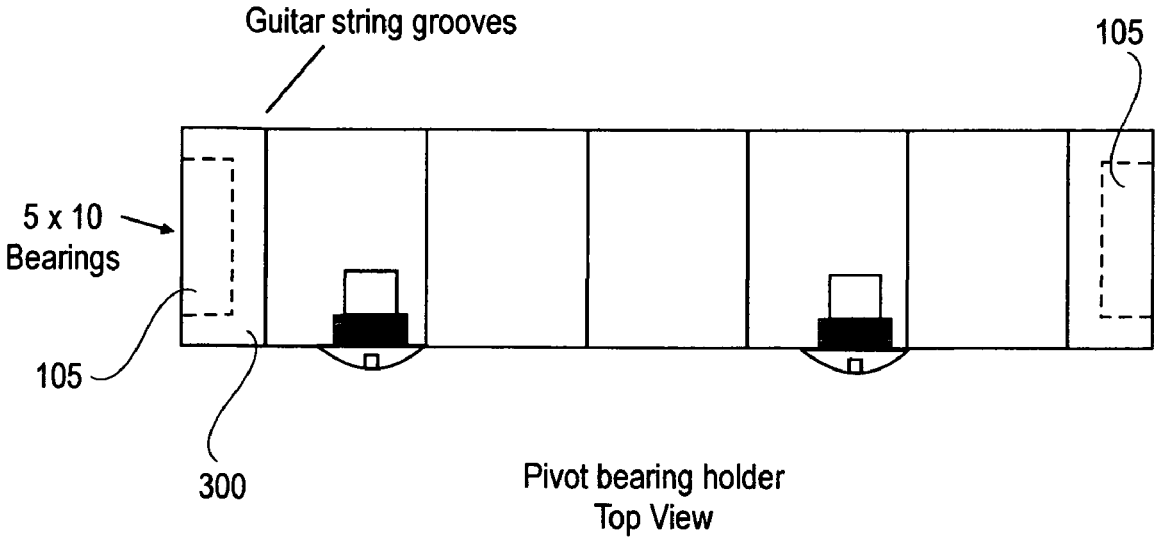
FIG. 3 illustrates a top view of an example embodiment of the pivot bearing holder.
Figure 3:
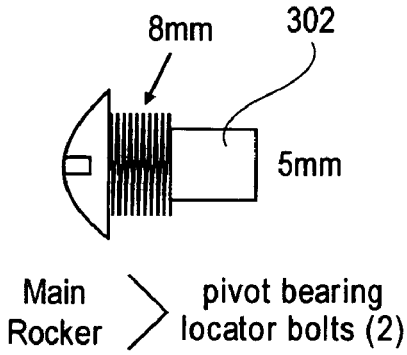
Figure 4:
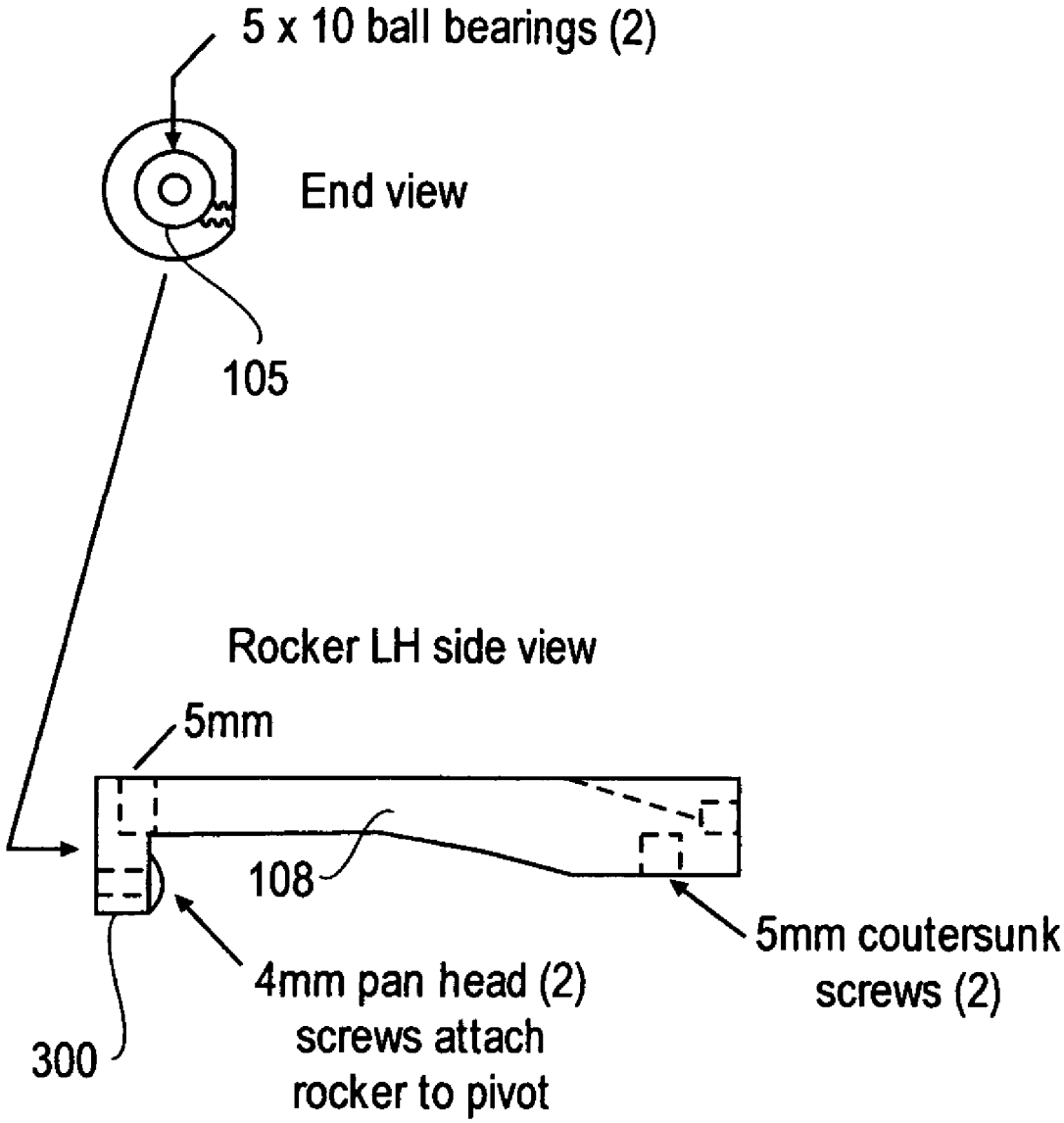
FIG. 4 illustrates a side view of an example embodiment of the rocker and pivot bearing holder.
Figure 5:
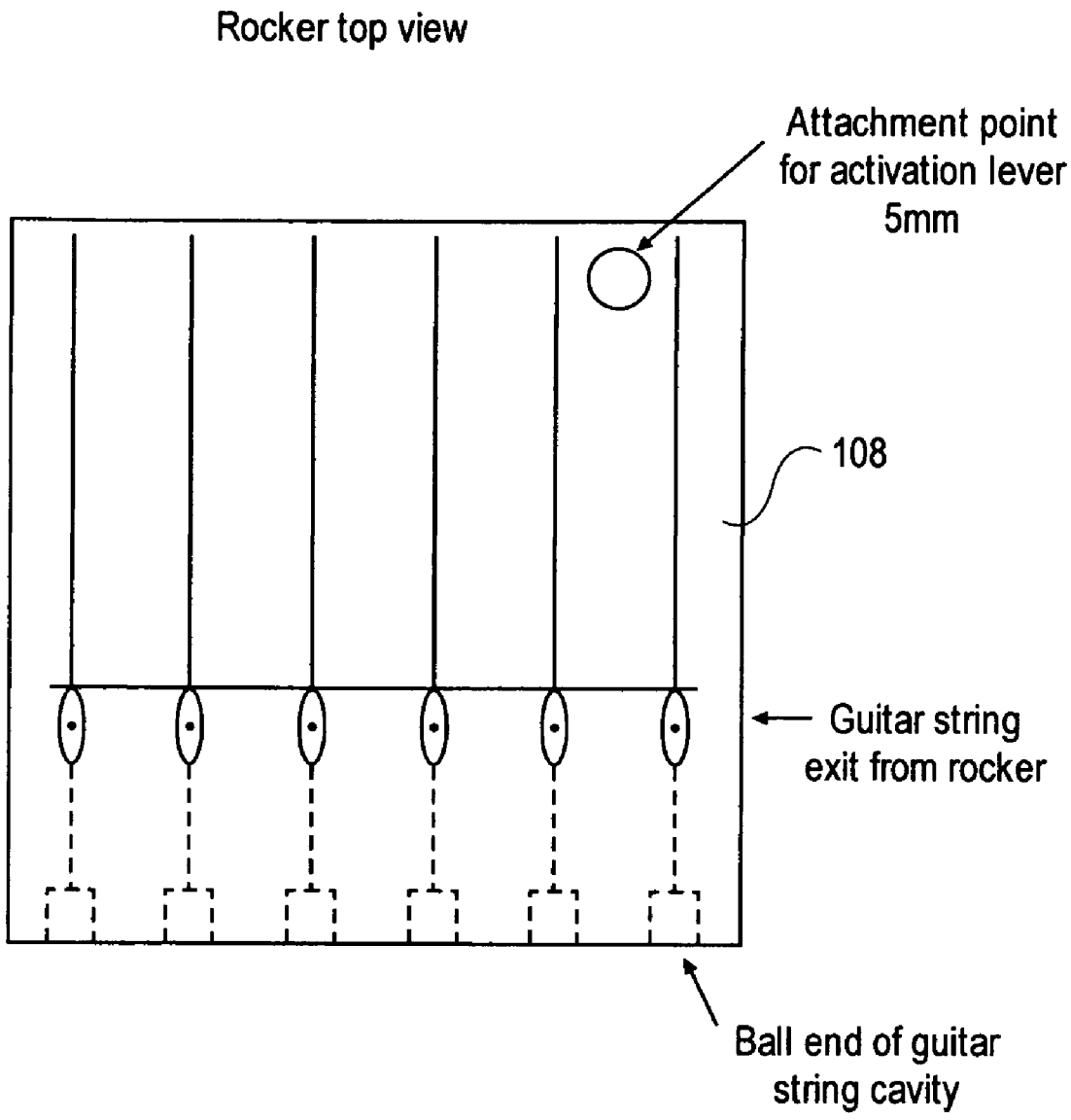
FIG. 5 illustrates a top view of an example embodiment of the rocker.
Figure 6:
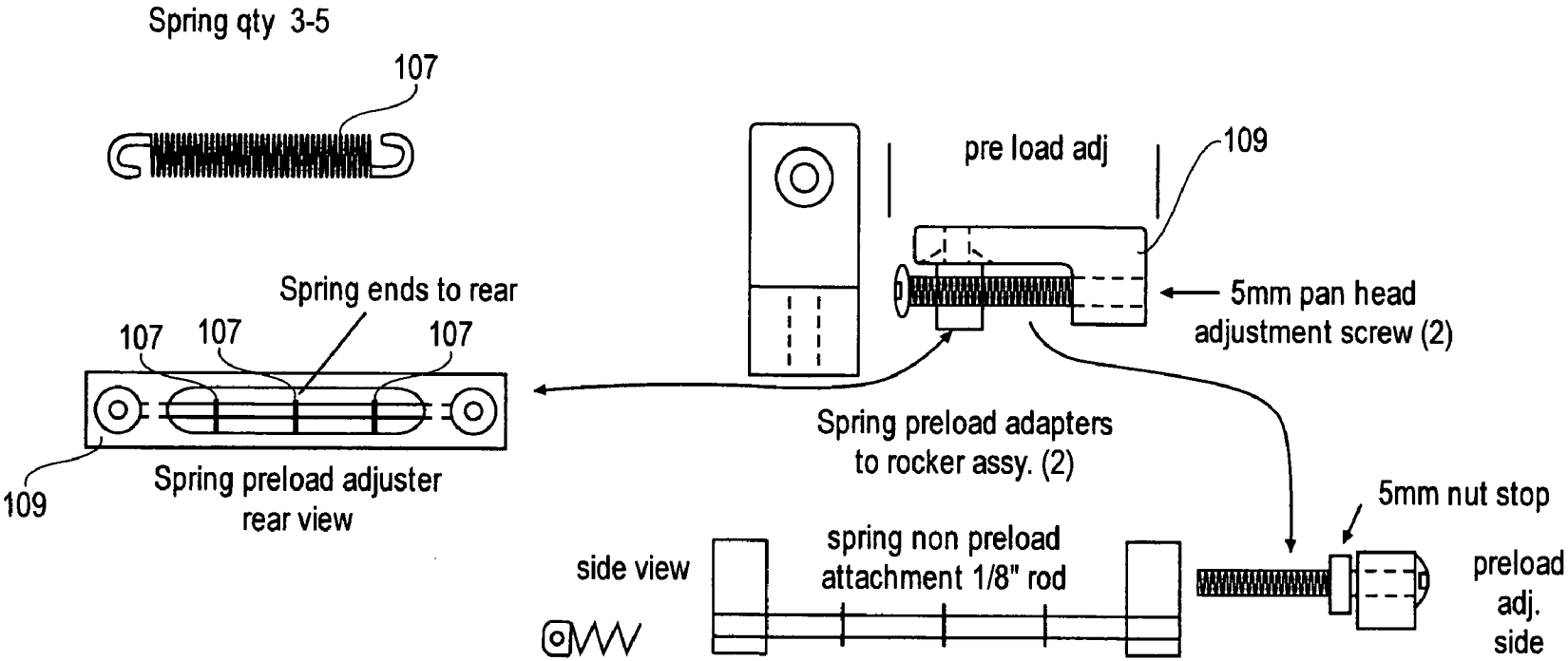
FIG. 6 illustrates a view of an example embodiment of the guitar spring preload adjuster.

Behind the first pivot 805 is the second pivot 806, shown in detail in FIGS. 3 and 4, which consists of a pivot bearing holder 300 in which two threaded pins 302, coming in from each side support bearings or roller 105 and the rocker mechanism 108 that controls the string movement. The pivot bearing holder 300 to which the rocker 108 is attached rotates about bearings or roller 105 to which the pivot bearing holder 300 is attached as shown in FIG. 4. As shown in FIGS. 1, 3 and 4, the rocker 108 is attached to the bearing holder and string guide 300, which is made of brass. The aluminum rocker 108 is attached to the pivot bearing holder 300 at the rear as shown in FIG. 4. As shown in FIG. 6, three extension springs 107 are held in a spring preload adjustment mechanism 109, which is mounted below and to the rear of the rocker 108 at two attachment points. The third pivot houses a pin 111 (shown in FIG. 1) at base-plate level and under the rocker pivot area. The three springs 107 are secured at their forward end by this pin 111. As shown in FIGS. 2 and 5, a rocker lever 110 attaches to the rocker 108 at the top.

As shown in FIG. 1, the guitar strings enter the tremolo system 100 of a particular embodiment, riding over the string controller rollers 102 then go under the grooved hold down rollers 104, and up and over the rocker bearing 105 of pivot bearing holder 300 in appropriately sized grooves (as shown in FIGS. 3 and 5), lying flat on top of the rocker 108 until entering into six downward angled drilled holes and end at the rear of the rocker 108 as shown in FIG. 5. All parts are either made of brass, aluminum, or stainless steel.

Figure 7:
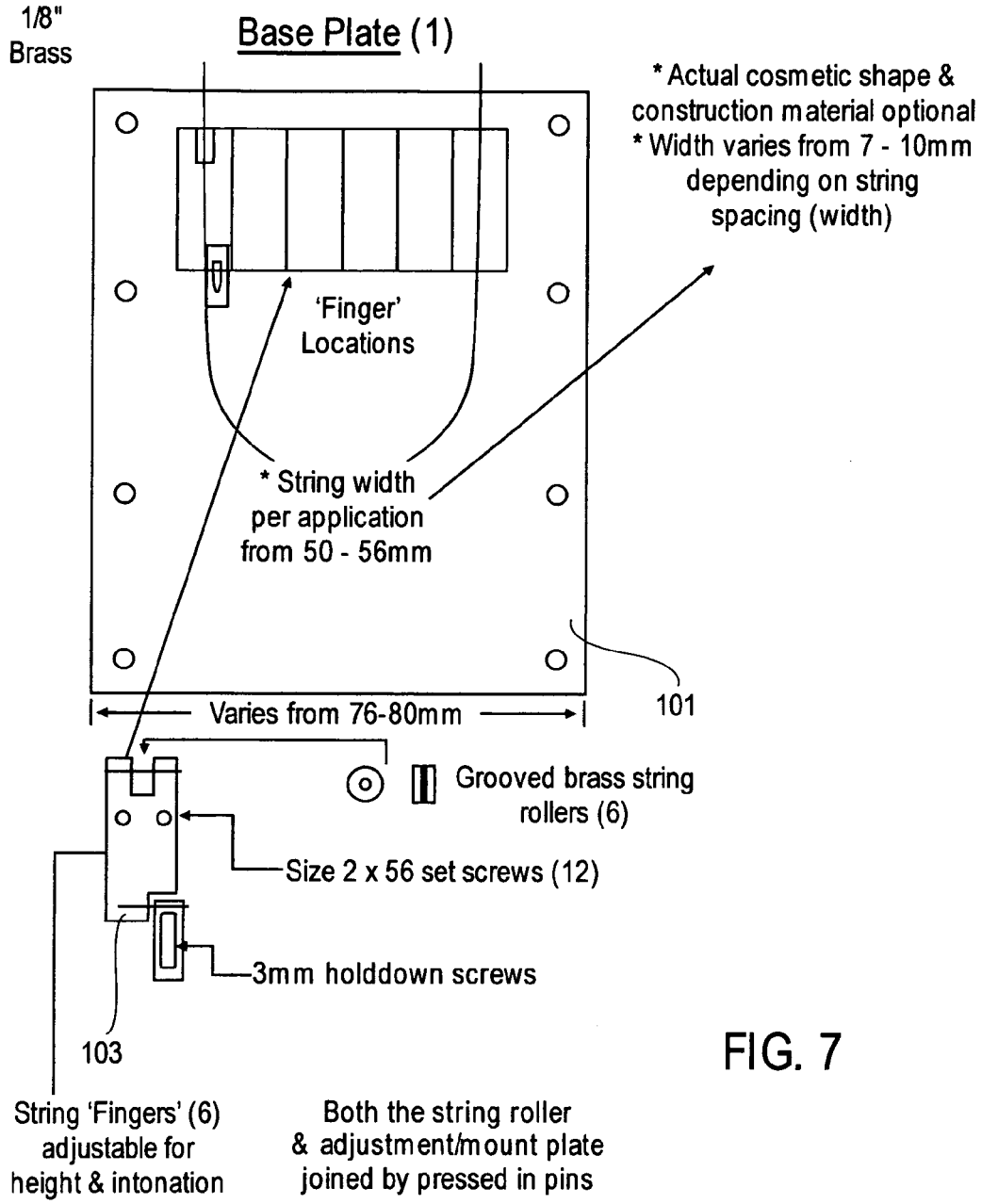
FIG. 7 illustrates a top view of an example embodiment of the base plate and string finger mechanism.

The various embodiments described herein provide a self contained surface-mount tremolo with a wide range of movement that enables the guitar to stay in tune. These embodiments also achieve a more technician-friendly design than existing systems. The embodiments have a large range of movement and mounts to a flat surface with only four size 8 wood screws. The tremolo is fully contained, with all components housed in a common "tray" chassis. A particular embodiment has six individual string fingers 103 with roller tips 102 and each individually controls string height (see FIG. 7). They are prevented from moving from side to side because of the sidewalls of the tray in which they sit. Intonation is set by loosening an individual 3 mm Allen screw and sliding the finger forwards of backwards. From the roller tip of the fingers, the strings are held down by a 5 mm pin 802, where six individual rollers 104 containing ball bearings guide the string upward to the front of the rocker mechanism 108. A particular embodiment consists of a hollowed out 14 mm round piece of brass, hollowed out and machined for two high quality ceramic nitride bearings 105 to mount it to the sides of the tray, using 8 mm pan head Allen screws with their ends machined down to the 5 mm J.D. of the bearings. The pivot bearing holder 300 also is grooved to the appropriate depth to guide the strings across it. I use two 4 mm Allen screws to secure the rocker assembly 108 to the pivot bearing holder 300. It is approximately 60 mm×60 mm and 4 mm thick. The strings ride on top of the rocker 108 and disappear down at approximately a 30 degree angle to the end. At the end, I mount the spring preload adjustment mechanism 109. It is easily adjusted from directly behind the approximately 80 mm×100 mm tremolo assembly. This attaches in close proximity of the ball end of the guitar strings. Three extension springs 107 are supported at their other end approximately 12 mm center to center beneath the front rocker pivot. I settled on three springs, but the preload adjuster 109 could house up to five springs of different rates. I use 0.009 through 0.042 medium gauge strings with the three chosen springs 107 of the suitable rates. I recommend the use of locking tuners and, either a roller or graphite type guitar neck nut. This will allow for secure string attachment and ease of movement for the strings passing through the neck nut while using the tremolo. My tremolo holds tuning well and is not prone to string breakage even under extreme use. I have the ride height of the rocker 108 set with the spring preload 109 to ride at a slight upward angle which allows well over a full octave of forward tremolo movement and a "Stretch", rear range from E up to A. These ranges are read on an electronic tuner on the bass E string. Changing the spring preload 109, or spring arrangement and the control lever 110 angle will allow the player to set the tremolo range less or more, inversely on front to back lever movements to suit him or her. With the lever 110 removed, the tremolo and guitar will fit in a standard guitar case. The nature of the design allows for further modification of rocker pivots, lengths and heights while retaining the original base plate and without disrupting the string fingers and their settings.

Figure 9:
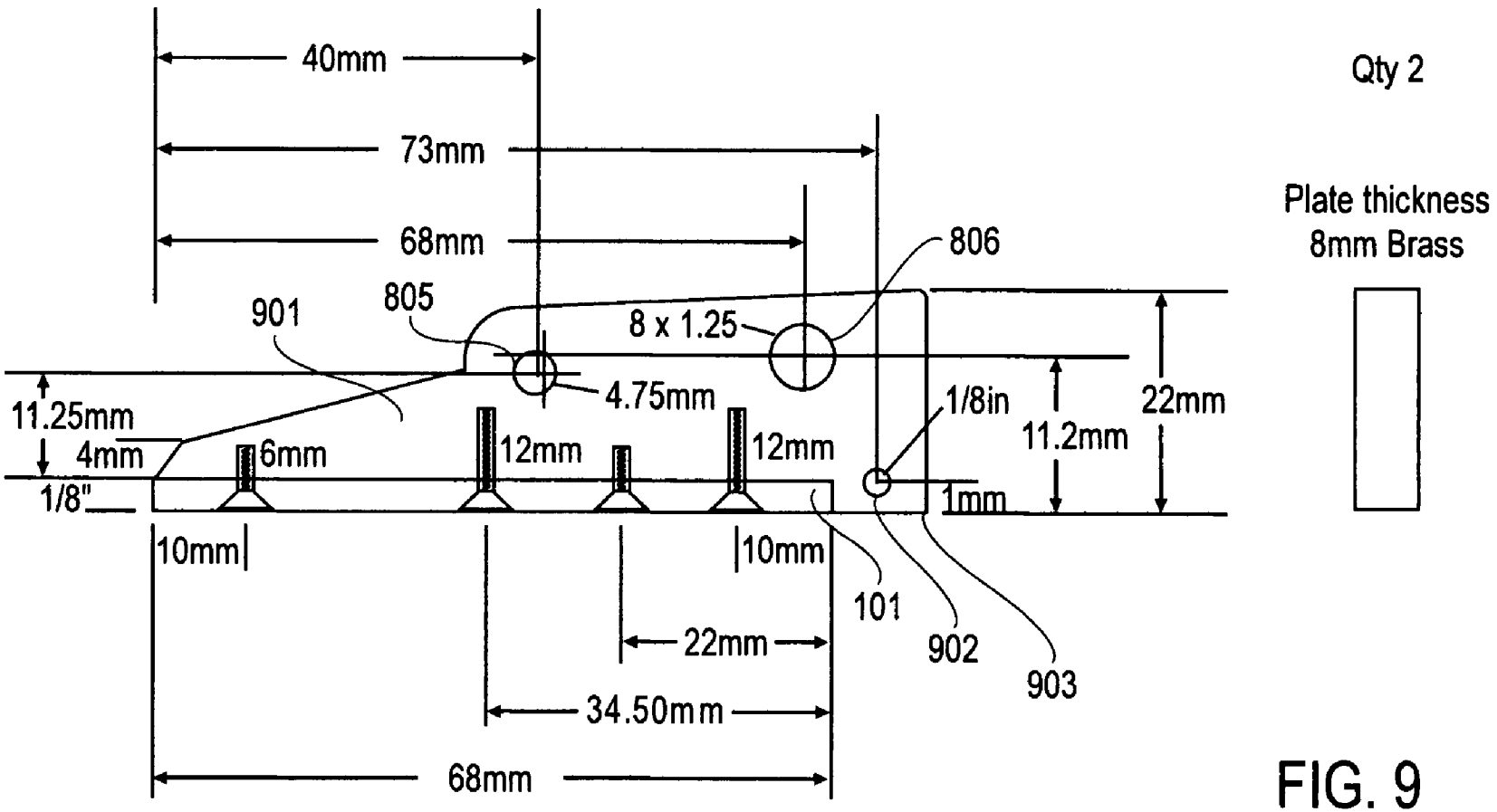
FIG. 9 illustrates a side view of an alternative embodiment of the side plate of the guitar tremolo system.

FIG. 9 illustrates a side view of an alternative embodiment of the side plate of the guitar tremolo system. In this embodiment, the dimensions of the hold-down rollers 104 and 105 are reduced slightly. The base plate 101 can be attached to two side plates 901 (shown in FIG. 9) of aluminum that support the three pivot points described above. The base plate 101 includes four attachment points to facilitate mounting the side plates 901 to the base plate 101. In this embodiment, the rear portion 903 of the side plates 901 is extended to be flush with the guitar surface and the lower face of the base plate 101. This embodiment allows the pin 902 to be lowered as well.

Figure 10:
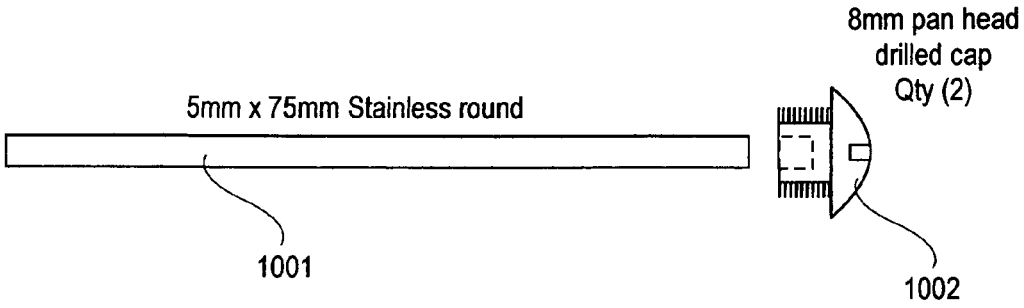
FIG. 10 illustrates an alternative embodiment of the rocker pivot pin.

FIG. 10 illustrates an alternative embodiment of the rocker pivot pin 1001. Panhead screws 1002 with a drilled cap can be used to attach the rocker pivot pin to the side plates 901.

Figure 11A:
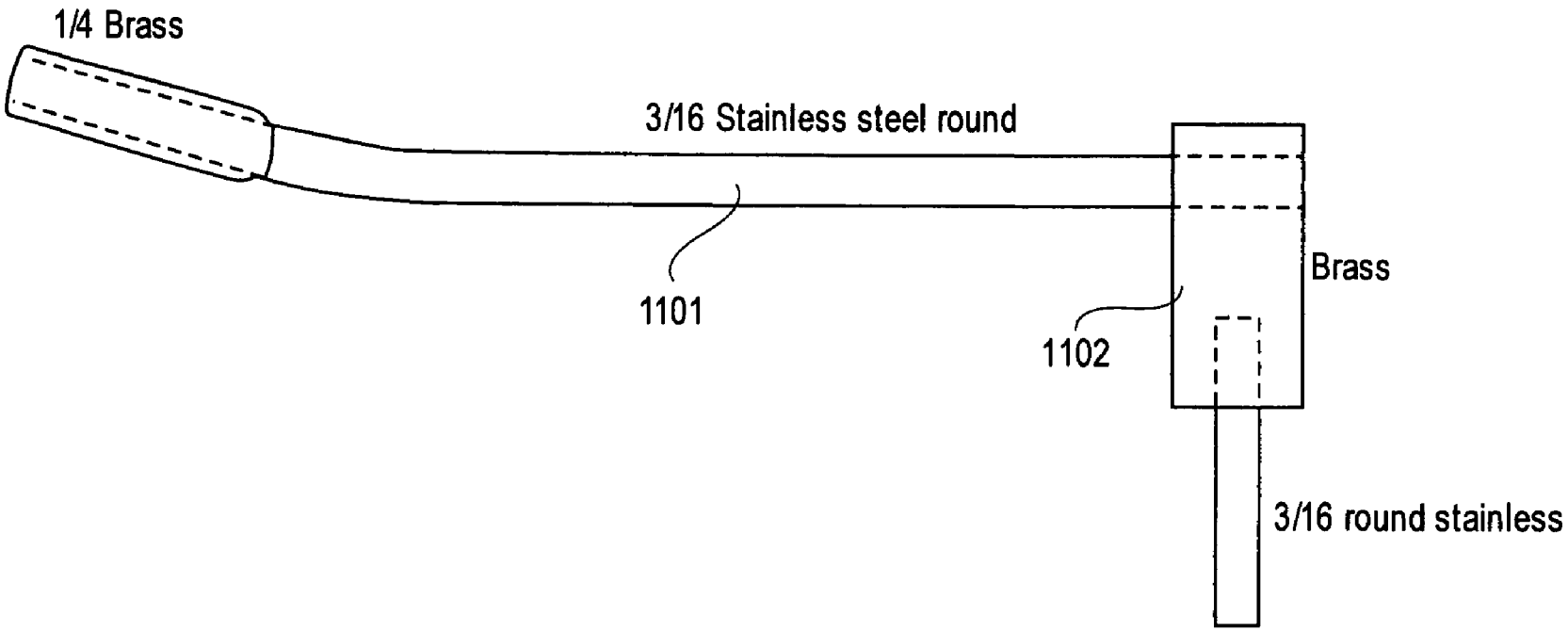
FIGS. 11A and 11B illustrate an alternative embodiment of the actuation or rocker arm and its receiver.
Figure 11B:
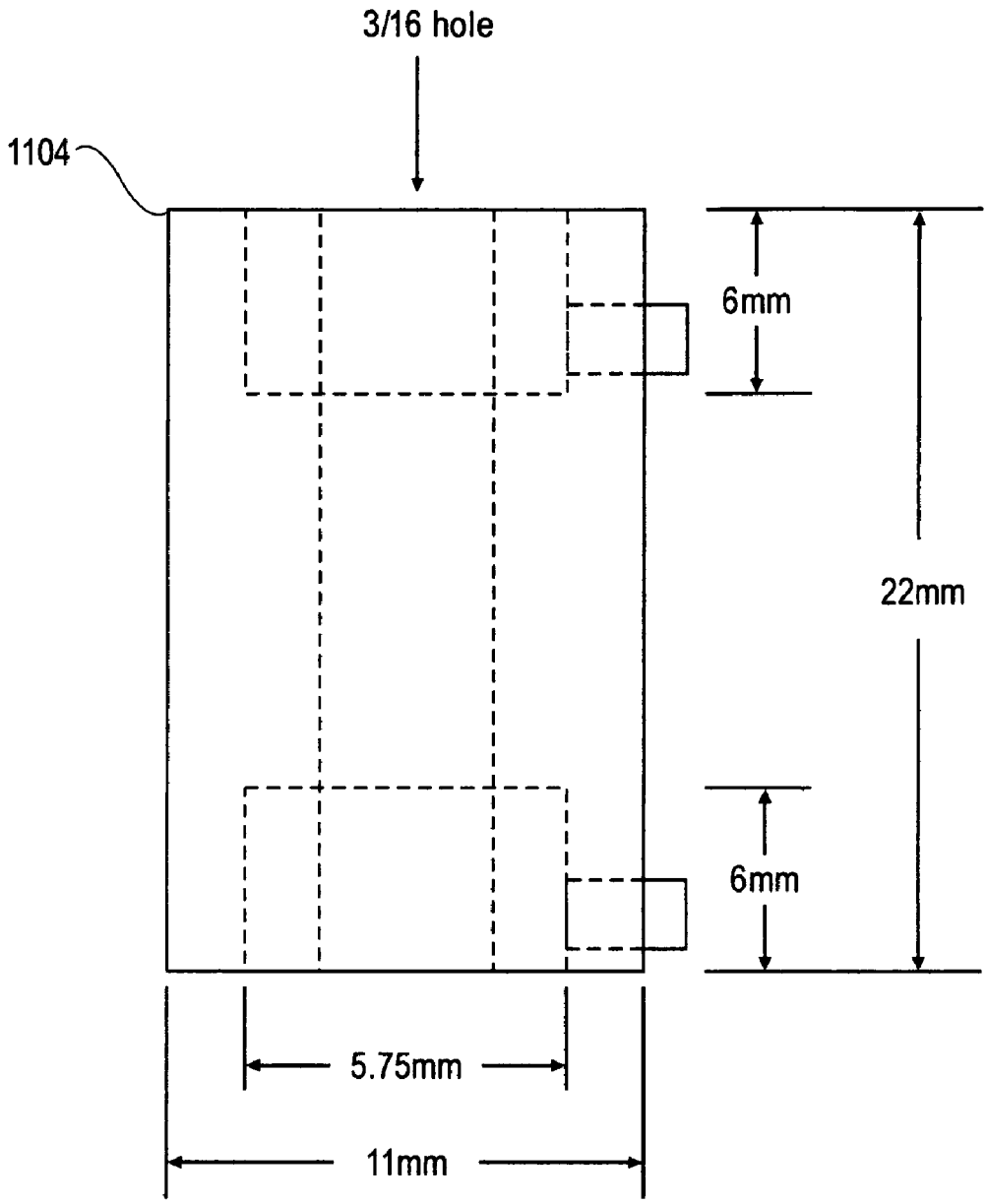

FIGS. 11A and 11B illustrate an alternative embodiment of the actuation or rocker arm 1101 and its receiver 1102. A pin of the receiver 1102 with the attached rocker arm 1101 can be mounted on the rocker 108 at the attachment point (see FIG. 5). As shown in FIG. 11B, set screws at the top and the bottom compress an aluminum sleeve 1104 to achieve a tight interference fit for the actuator arm 1101. The receiver 1102 and sleeve 1104 enables quick attachment/detachment of the rocker actuation arm 1101. The quick attachment/detachment of the rocker actuation arm 1101 in this embodiment provides a tighter and more secure feel between the actuation arm and the rocker.

Figure 12:
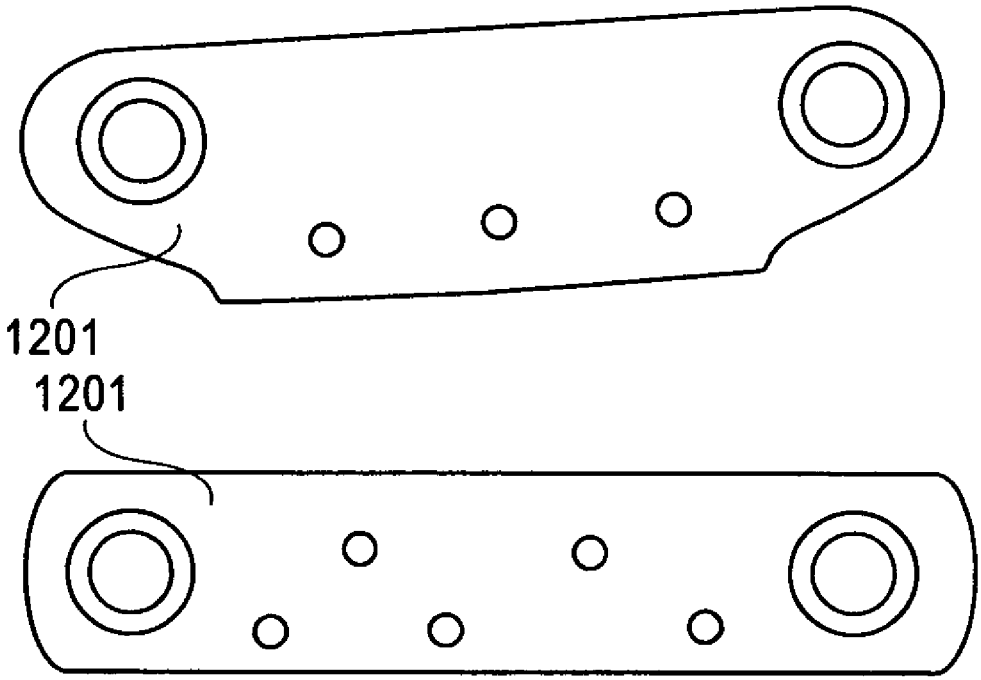
FIG. 12 illustrates an alternative embodiment of the adapter plates and screws.

FIG. 12 illustrates an alternative embodiment of the adapter plates 1201 and screws. The adapter plates 1201 provide for adaptation to a common 'Four-Post' bridge arrangement attachment to the guitar body.

Figure 13:
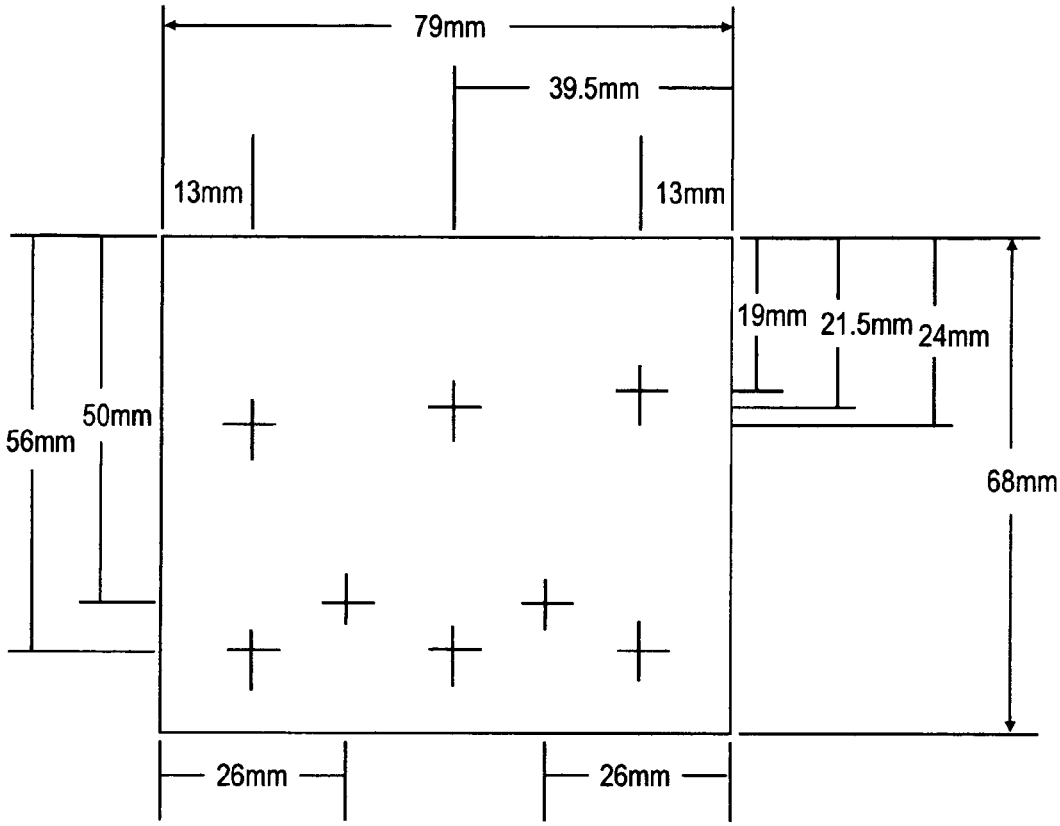
FIG. 13 illustrates an embodiment showing the location of screw holes for base plate attachment to the adapter plates.

FIG. 13 illustrates an embodiment showing the location of screw holes for base plate 101 attachment to adapter plates 1201.

Figure 14:
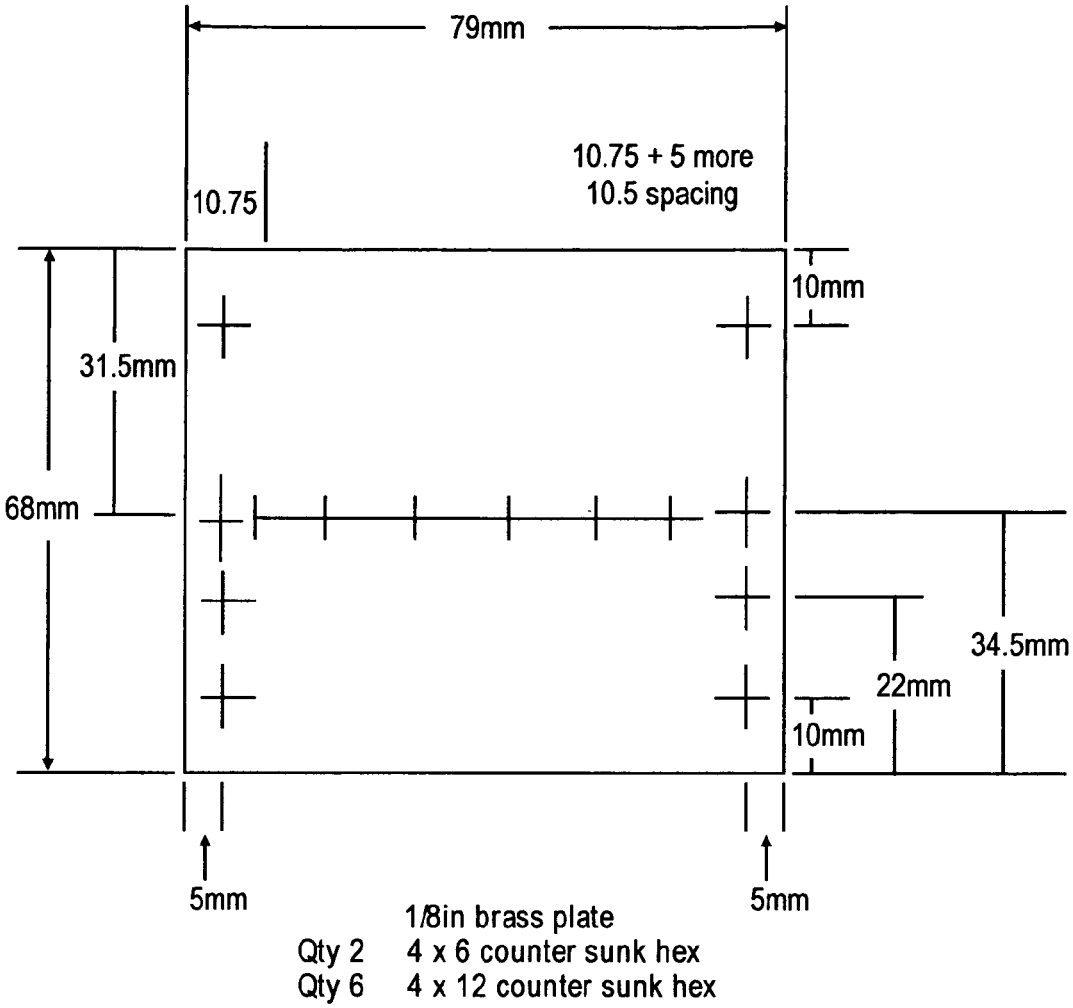
FIG. 14 illustrates an embodiment showing the location of screw holes for base plate attachment to the side plates.

FIG. 14 illustrates an embodiment showing the location of screw holes for base plate 101 attachment to side plates 901.

The various embodiments described herein provide the guitar player with a wide variance of tonal pitches, ranging from sharp to flat from tune center. The tremolo system is modular in construction, allowing modification of parts, exchange of various components, and modification of specific qualities, functional and cosmetic, while retaining a large portion of the original system. The modular construction of various embodiments enables modification of the device without purchasing an entirely new device.

The various embodiments described herein enable the tremolo system to support the rear of the guitar strings and allow pitch variance over a wide range, by relaxing and stretching individual strings. All points of contact or movement of strings are suspended on rollers or ball bearing per individual string, achieving excellent tune stability and prevention of string breakage. The various embodiments are extremely easy to retro fit or mount to new guitars because the tremolo is self-contained above its base plate. The various embodiments usually only require the drilling of four #8 wood screw holes or reusing the existing guitar mounting posts. The latter would require individually specific adapters, to be provided.

The various embodiments of the tremolo design described herein are applicable for guitars of various types, including 6-string guitars, 12-string guitars, 7-string guitars, bass guitars, and other stringed musical instruments. The 12 string tremolo of a particular embodiment is similar to the example 6-string tremolo described herein, with the exception of the E, A, D, G pairings of strings. The only difference with these four pairs of strings is that each of these eight strings has their own hold-down roller as described above. Additionally, the controller fingers, (quantity 4) can have split rollers. Split rollers means just that there are two tiny rollers per those four fingers on their tips. This is done because those pairings of strings are of different gauge and stretch rate. Also, there are (quantity 4) ceramic nitride bearings on the main rocker pivot instead of (quantity 2). Of course, there is an additional spring (typically a stiffer spring) to counter the pull of the 12 strings. Finally, there are twelve drilled holes in the rocker to anchor the strings. In a particular embodiment, the final B and high E string pairings are not split; because they are just two pairings of identical gauge strings Thus, these string pairs should not need split rollers.

In a particular embodiment, a "camshaft" lobe configuration can be formed into the pivot bearing holder (e.g., see FIG. 3, item 300). In place of the string grooves cut in the pivot bearing holder 300 shown in FIG. 3, the pivot bearing holder 300 can be configured with various sized grooved cam profiles. These cam profiles can include larger or smaller (i.e., higher or lower) profiles for each individual string. This cam profile configuration makes it possible to make all strings or any individual string stretch of relax at an endless variety of different rates relative to each of the other strings. Additionally, as with the regular round pivot bearing holder, the existing geometry and springing mechanism will always return each string back to "Tune Neutral" no matter what profile is provided for each string.

The various embodiments described herein are a fully self-contained surface-mount modular tremolo system, including the string bridge. The tremolo system mounts to guitar bodies without any modification or "routing out" of the guitar body. The entire system is housed above the main base plate. This device achieves a much greater range of tremolo movement for variance of pitch than any existing surface-mount system currently manufactured. It provides easy access to spring preload adjustment, individual string height, and intonation settings. The tremolo system is modular in construction, allowing the owner to modify specific qualities, functional and cosmetic, while retaining a large portion of the original system, and without upsetting intonation and string height settings. Particular embodiments feature a full floating system, where individual rollers and/or ball bearings, per individual strings, suspend all points of contact or movement. The tremolo system stays in tune longer and resists string breakage. This tremolo system is of a unique style and modular design.

The illustrations of embodiments described herein are intended to provide a general understanding of the structure of various embodiments, and they are not intended to serve as a complete description of all the elements and features of apparatus and systems that might make use of the structures described herein. Many other embodiments will be apparent to those of ordinary skill in the art upon reviewing the above description. Other embodiments may be utilized and derived therefrom, such that structural and logical substitutions and changes may be made without departing from the scope of this disclosure. The figures provided herein are merely representational and may not be drawn to scale. Certain proportions thereof may be exaggerated, while others may be minimized. Accordingly, the specification and drawings are to be regarded in an illustrative rather than a restrictive sense.

The description herein may include terms, such as "up", "down", "upper", "lower", "first", "second", etc. that are used for descriptive purposes only and are not to be construed as limiting. The elements, materials, geometries, dimensions, and sequence of operations may all be varied to suit particular applications. Parts of some embodiments may be included in, or substituted for, those of other embodiments. While the foregoing examples of dimensions and ranges are considered typical, the various embodiments are not limited to such dimensions or ranges.

The Abstract is provided to comply with 37 C.F.R. §1.74(b) to allow the reader to quickly ascertain the nature and gist of the technical disclosure. The Abstract is submitted with the understanding that it will not be used to interpret or limit the scope or meaning of the claims.

In the foregoing Detailed Description, various features are grouped together in a single embodiment for the purpose of streamlining the disclosure. This method of disclosure is not to be interpreted as reflecting an intention that the claimed embodiments have more features than are expressly recited in each claim. Thus, the following claims are hereby incorporated into the Detailed Description, with each claim standing on its own as a separate embodiment.

Thus, a self-contained, surface-mount guitar tremolo is disclosed. While the present invention has been described in terms of several example embodiments, those of ordinary skill in the art can recognize that the present invention is not limited to the embodiments described, but can be practiced with modification and alteration within the spirit and scope of the appended claims. The description herein is thus to be regarded as illustrative instead of limiting.

What is claimed is:

1. An apparatus comprising:

a surface-mount base plate;

a plurality of individually adjustable string fingers attached to the base plate;

side plates attached to the base plate;

a first pivot roller attached to the side plates;

a second pivot roller attached to the side plates;

a rocker attached to the second pivot roller; and a spring preload adjuster attached to the rocker, the spring preload adjuster including a plurality of springs attached at one end to the base plate and attached at a second end to the spring preload adjuster.

2. The apparatus as claimed in claim 1 wherein each of the plurality of individually adjustable string fingers includes a grooved roller.

3. The apparatus as claimed in claim 1 wherein the first pivot roller includes string grooves.

4. The apparatus as claimed in claim 1 wherein the rocker is attached to the second pivot roller via a pivot bearing holder.

5. The apparatus as claimed in claim 1 including an actuation lever attached to the rocker.

6. The apparatus as claimed in claim 1 wherein the rocker includes a plurality of angled holes into which the strings can be inserted.

7. The apparatus as claimed in claim 1 wherein the spring preload adjuster includes three springs.

8. The apparatus as claimed in claim 1 wherein the first pivot roller is attached to the side plates with a pin.

9. The apparatus as claimed in claim 1 wherein the side plates are attachable to a guitar body with a plurality of screws.

10. The apparatus as claimed in claim 1 wherein the first pivot roller is made of brass.

* * * * *